US011778388B2

(12) United States Patent
Wen et al.

(10) Patent No.: US 11,778,388 B2
(45) Date of Patent: Oct. 3, 2023

(54) SPEAKER

(71) Applicant: Transound Electronics Co., Ltd., Dongguan (CN)

(72) Inventors: Tseng-Feng Wen, Dongguan (CN); Huming Zheng, Dongguan (CN); Hui Xue, Dongguan (CN)

(73) Assignee: Transound Electronics Co., Ltd., Dongguan (CN)

( * ) Notice: Subject to any disclaimer, the term of this patent is extended or adjusted under 35 U.S.C. 154(b) by 0 days.

(21) Appl. No.: 17/695,805

(22) Filed: Mar. 15, 2022

(65) Prior Publication Data

US 2023/0097640 A1 Mar. 30, 2023

(30) Foreign Application Priority Data

Sep. 28, 2021 (CN) ..... 202122363556.5

(51) Int. Cl.

| | |
|---|---|
| ***H04R 9/06*** | (2006.01) |
| ***H04R 7/06*** | (2006.01) |
| ***H04R 1/02*** | (2006.01) |
| ***H04R 9/02*** | (2006.01) |
| ***H04R 7/18*** | (2006.01) |

(52) U.S. Cl.
CPC ..... *H04R 9/06* (2013.01); *H04R 1/023* (2013.01); *H04R 7/06* (2013.01); *H04R 7/18* (2013.01); *H04R 9/025* (2013.01)

(58) Field of Classification Search
CPC ... H04R 7/02; H04R 7/04; H04R 9/06; H04R 9/025; H04R 1/023
See application file for complete search history.

(56) References Cited

U.S. PATENT DOCUMENTS 9,955,266 B2 * 4/2018 Liu ..... H04R 7/125
2020/0413199 A1 * 12/2020 Song ..... H04R 9/06

* cited by examiner

*Primary Examiner* — Sunita Joshi
(74) *Attorney, Agent, or Firm* — ScienBiziP, P.C.

(57) ABSTRACT

A speaker includes a speaker body and a diaphragm. The diaphragm is a planar structure. The speaker body includes a positioning structure. The positioning structure has a cavity penetrating front and back sides of the positioning structure. The diaphragm is positioned on the positioning structure. The diaphragm is in the form of a planar structure, instead of a curved or spherical structure. The planar structure of the diaphragm is simplified, so that the manufacturing process of the diaphragm is simpler.

9 Claims, 5 Drawing Sheets

SPEAKER

BACKGROUND OF THE INVENTION

1. Field of the Invention

The present invention relates to a speaker, and more particularly to a speaker having a diaphragm in the form of a planar structure.

2. Description of the Prior Art

A conventional speaker generally includes a holder. A U-shaped cup and a diaphragm are installed to the holder. A magnet and a washer are installed in the U-shaped cup and form a magnetic gap. A voice coil is installed on the diaphragm. The voice coil extends to the magnetic gap. The wire is electrically connected to the voice coil for the voice coil to vibrate the diaphragm to produce sounds.

In general, the diaphragm of the conventional speaker is a curved surface structure. Some diaphragm structures include a flat surface, a curved surface, and a spherical surface. Such a diaphragm, due to the curved surface and spherical surface, the structure of the diaphragm is complex, which leads to a complex process for manufacturing the diaphragm and requires complex processing equipment for forming a curved or spherical surface. Such a complex diaphragm is not conducive to assembly. When it is assembled and combined with the speaker, the overall manufacturing process of the speaker will be complicated and the manufacturing cost will be increased. Due to the influence of the curved or spherical surface, the sound produced by the vibration of such a diaphragm is not uniform. As a result, when it is combined with the speaker, the frequency response curve of the speaker is not smooth enough to produce uniform sounds.

Accordingly, the inventor of the present invention has devoted himself based on his many years of practical experiences to solve these problems.

SUMMARY OF THE INVENTION

In view of shortcomings of the prior art, the primary object of the present invention is to provide a speaker having a diaphragm in the form of a planar structure, instead of a curved or spherical structure. The planar structure of the diaphragm is simplified, so that the manufacturing process of the diaphragm is simpler. There is no need for complex processing equipment for forming the curved or spherical surface. The diaphragm with a simplified and planar structure does not require complicated assembly and positioning, which is beneficial for assembly. When the diaphragm is assembled and combined with the speaker, the overall manufacturing process of the speaker is simpler and the manufacturing cost is reduced. The diaphragm of the planar structure won't be affected by the influence of the curved or spherical surface, so that the diaphragm is vibrated to produce uniform sounds.

In order to achieve the above object, the present invention adopts the following technical solutions.

A speaker comprises a speaker body and a diaphragm. The diaphragm is a planar structure. The speaker body includes a positioning structure. The positioning structure has a cavity penetrating front and back sides of the positioning structure. The diaphragm is positioned on the positioning structure.

Compared with the prior art, the present invention has obvious advantages and beneficial effects. Specifically, it can be seen from the above technical solution that the diaphragm is designed into a planar structure, instead of a curved or spherical structure. The planar structure of the diaphragm is simplified, so that the manufacturing process of the diaphragm is simpler. There is no need for complex processing equipment for forming the curved or spherical surface. The diaphragm with a simplified and planar structure does not require complicated assembly and positioning, which is beneficial for assembly. When the diaphragm is assembled and combined with the speaker, the overall manufacturing process of the speaker is simpler and the manufacturing cost is reduced. The diaphragm of the planar structure won't be affected by the influence of the curved or spherical surface, so that the diaphragm is vibrated to produce uniform sounds. When the diaphragm is combined with the speaker, the frequency response curve of the speaker is smoother to produce uniform sounds. Through the positioning structure, the diaphragm can be stably positioned on the positioning structure. The positioning structure has a cavity penetrating the front and back sides of the positioning structure, so that the sound can pass through the cavity. Thus, the diaphragm communicates with the magnetic circuit assembly in the main body of the speaker, so as to prevent the positioning structure from blocking the sound. The surface of the diaphragm is plated with a plating layer to improve the durability of the diaphragm. The rigidity of the diaphragm can be increased. The softness of the diaphragm is maintained. The sensitivity is increased. The frequency band is wider. The high frequency problem can be solved well. The sound quality is better.

DETAILED DESCRIPTION OF THE PREFERRED EMBODIMENTS

Figure 1:
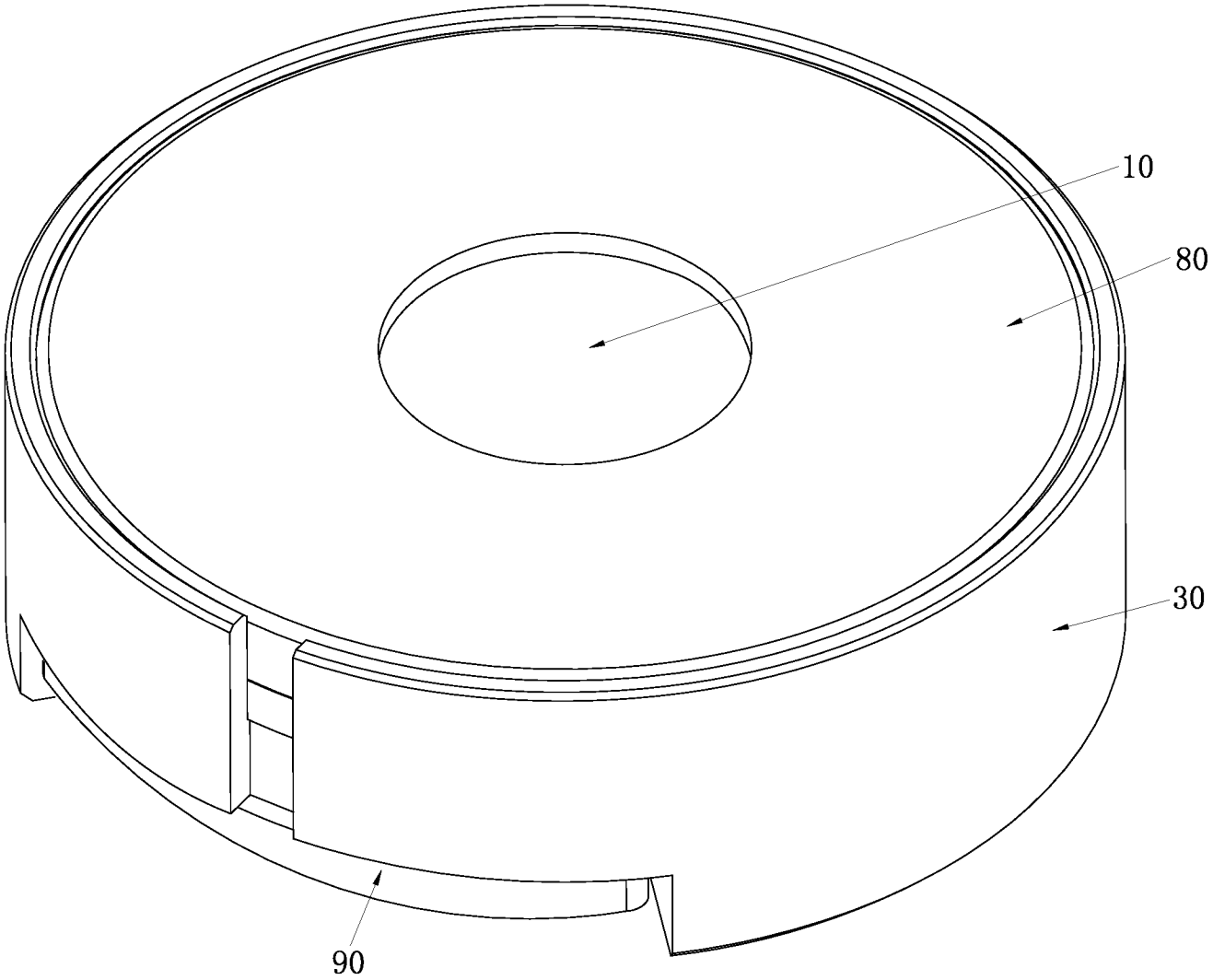
FIG. 1 is a perspective view of a preferred embodiment of the present invention.
Figure 2:
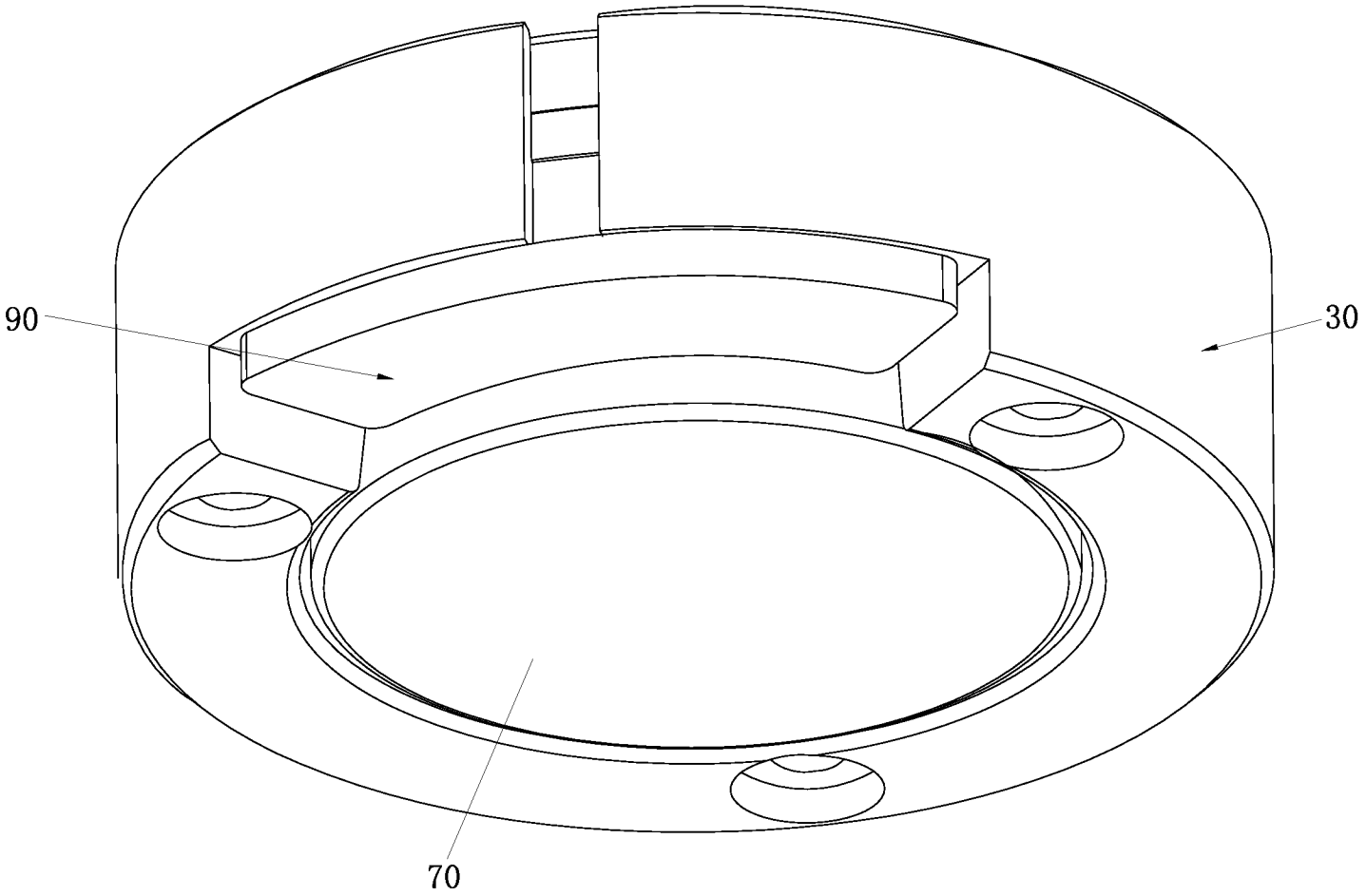
FIG. 2 is another perspective view of the preferred embodiment of the present invention.

Embodiments of the present invention will now be described, by way of example only, with reference to the accompanying drawings.

As shown in FIG. 1 through FIG. 5, a speaker comprises a speaker body and a diaphragm 10. The diaphragm 10 is a planar structure. The speaker body includes a positioning structure 20. The positioning structure 20 has a cavity 21 penetrating the front and back sides of the positioning structure 20. The diaphragm 10 is positioned on the positioning structure 20. The diaphragm 10 is designed into a planar structure, instead of a curved or spherical structure. The planar structure of the diaphragm 10 is simplified, so that the manufacturing process of the diaphragm 10 is simpler. There is no need for complex processing equipment for forming the curved or spherical surface. The diaphragm 10 with a simplified and planar structure does not require complicated assembly and positioning, which is beneficial for assembly. When the diaphragm 10 is assembled and combined with the speaker, the overall manufacturing process of the speaker is simpler and the manufacturing cost is reduced. The diaphragm 10 of the planar structure won't be affected by the influence of the curved or spherical surface, so that the diaphragm 10 is vibrated to produce uniform sounds. When the diaphragm 10 is combined with the speaker, the frequency response curve of the speaker is smoother to produce uniform sounds. The frequency response of the speaker can reach more than 15 KHz. Specifically, the speaker body includes a holder 30, a voice coil 40, a washer 50, a magnet 60, and a U-shaped cup 70. The back side of the positioning structure 20 is attached to the front side of the holder 30. The periphery of the back side of the diaphragm 10 is positioned on one side of the positioning structure 20, facing away from the holder 30 (i.e., the front side of the positioning structure 20). The U-shaped cup 70 is mounted on the holder 30 and extends to the back side of the holder 30. The magnet 60 is disposed in the U-shaped cup 70. The washer 50 is disposed on top of the magnet 60. One end of the voice coil 40 passes through the cavity 21 and is mounted to the back side of the diaphragm 10, and the other end of the voice coil 40 is located between the magnet 60 and the U-shaped cup 70.

Figure 3:
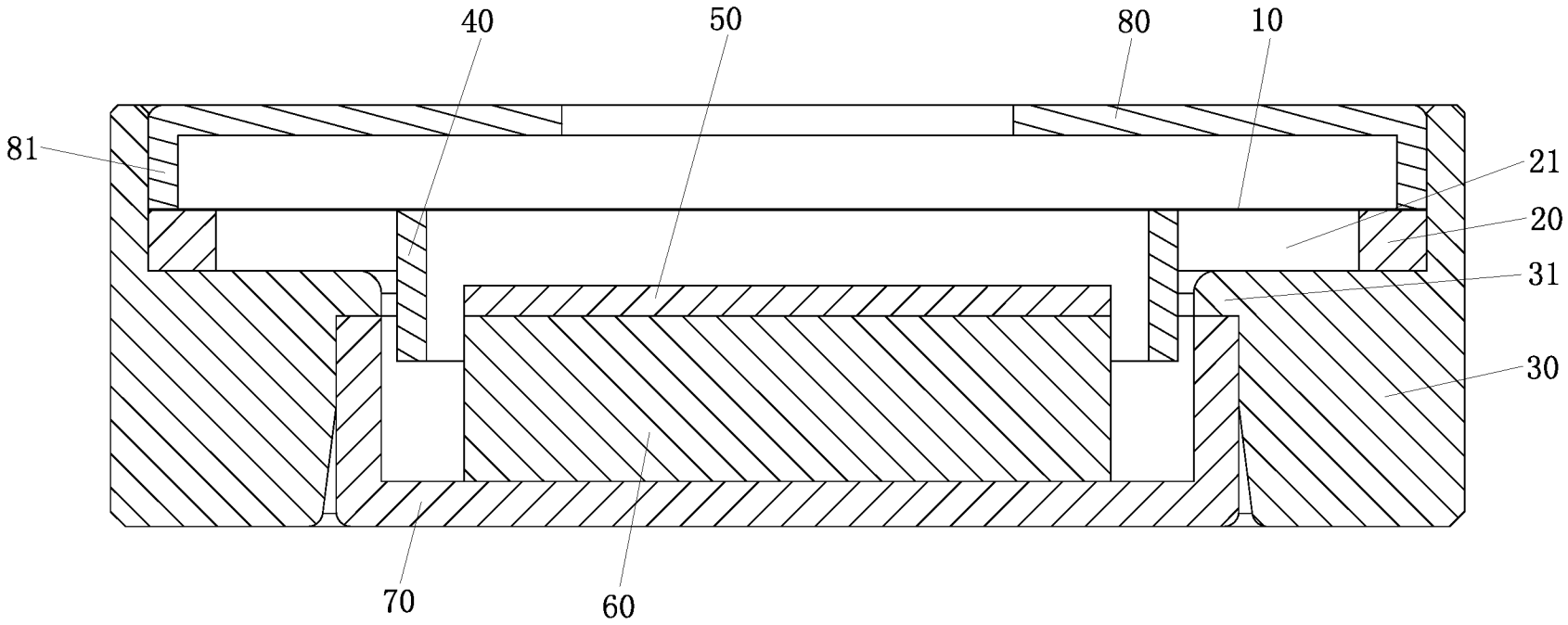
FIG. 3 is a cross-sectional view of the preferred embodiment of the present invention.

As shown in FIG. 3, the speaker body further includes a protective cover 80. The protective cover 80 covers the front side of the diaphragm 10. The periphery of the protective cover 80 is restricted by the inner wall of the holder 30. The protective cover 80 has an annular restricting portion 81 extending backward from the back side of the protective cover 80. The periphery of the front side of the diaphragm 10 is restricted by the annular restricting portion 81.

Figure 4:
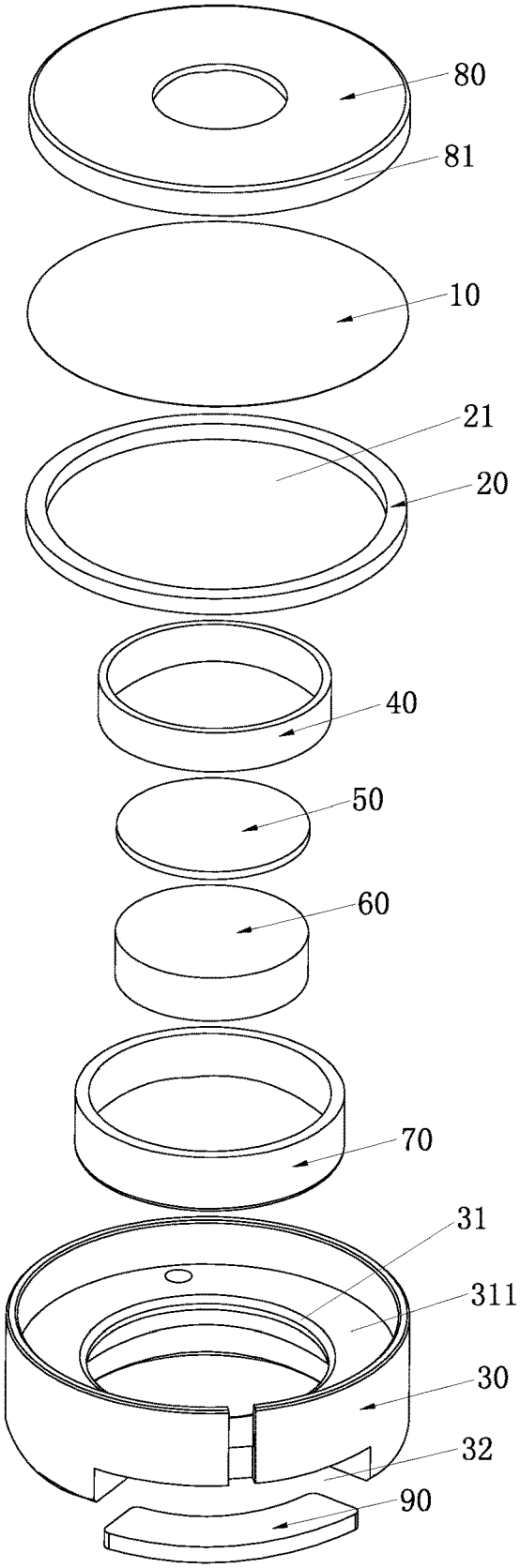
FIG. 4 is an exploded view of the preferred embodiment of the present invention.
Figure 5:
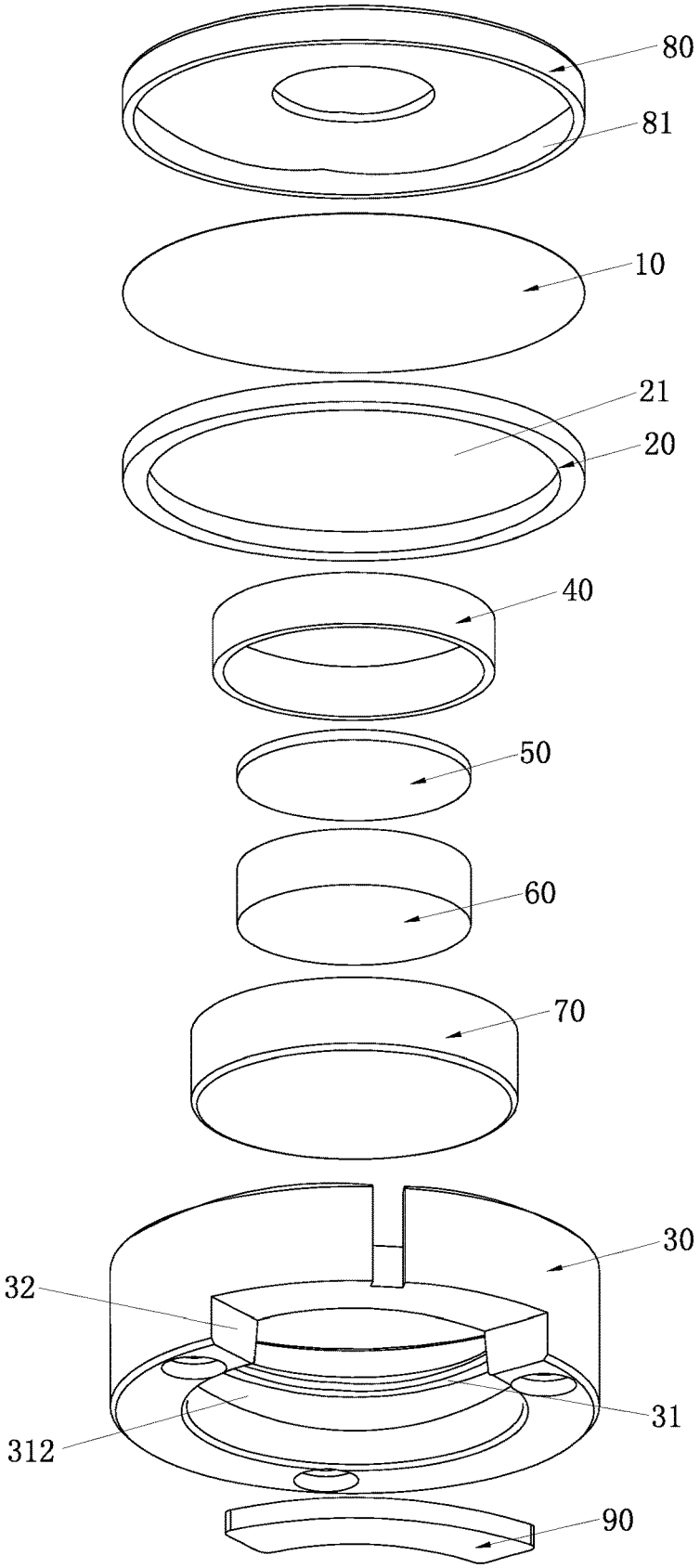
FIG. 5 is another exploded view of the preferred embodiment of the present invention.

As shown in FIG. 3 through FIG. 5, the holder 30 has two open ends. The inner wall of the holder 30 has an annular positioning portion 31. The front and back sides of the annular positioning portion 31 are formed with a first mounting seat 311 and a second mounting seat 312, respectively. The positioning structure 20 and the U-shaped cup 70 are mounted to the first mounting seat 311 and the second mounting seat 312, respectively. The periphery of the positioning structure 20 is restricted by the inner wall of the holder 30. The first mounting seat 311 and the second mounting seat 312 are a first annular restricting face and a second annular restricting face, respectively. The positioning structure 20 and the U-shaped cup 70 are attached to the first annular restricting face and the second annular restricting face, respectively.

As shown in FIG. 4 and FIG. 5, the back side of the holder 30 is formed with a positioning groove 32. A circuit board 90 is provided in the positioning groove 32. The positioning groove 32 is an arc-shaped positioning groove 32. The circuit board 90 is an arc-shaped circuit board 90.

As shown in FIG. 3 through FIG. 5, the positioning structure 20 is an annular structure. The periphery of the back side of the diaphragm 10 is positioned on the front side of the annular structure. The back side of the annular structure is restricted by the first mounting seat 311 (i.e., the first annular restricting face) of the holder 30 of the speaker body. Preferably, the annular structure is a metal ring. The annular structure is not limited to a metal ring, which may be an annular structure made of other materials.

The holder 30, the diaphragm 10 and the metal ring have the same shape and structure. As shown in FIG. 4, in this embodiment, the holder 30, the diaphragm 10 and the metal ring are all circular structures. The holder 30, the diaphragm 10 and the metal ring may be of a square structure or a racetrack-shaped structure, or may be of other shapes. In addition, in this embodiment, the voice coil 40 is a circular structure. The voice coil 40 may be changed in shape corresponding to the shape of the speaker, that is, the voice coil 40 may be a square structure, a racetrack-shaped structure, an elliptical structure, or other shapes.

Furthermore, in this embodiment, the surface of the diaphragm 10 is plated with a plating layer. The plating layer is preferably a metal layer. The surface of the diaphragm 10 may be not plated with a plating layer. The plating layer depends on the actual production requirements. The surface of the diaphragm 10 is plated with a plating layer to improve the durability of the diaphragm. The rigidity of the diaphragm can be increased. The softness of the diaphragm is maintained. The sensitivity is increased. The frequency band is wider. The high frequency problem can be solved well. The sound quality is better.

What is claimed is:

1. A speaker, comprising a speaker body and a diaphragm, the diaphragm being a planar structure, the speaker body including a positioning structure, the positioning structure having a cavity penetrating front and back sides of the positioning structure, the diaphragm being positioned on the positioning structure; wherein the speaker body includes a holder, a voice coil, a washer, a magnet and a U-shaped cup, the positioning structure is attached to a front side of the holder, a periphery of a back side of the diaphragm is positioned on one side of the positioning structure, facing away from the holder, the U-shaped cup is mounted on the holder and extends to a back side of the holder, the magnet is disposed in the U-shaped cup, the washer is disposed on top of the magnet, one end of the voice coil passes through the cavity and is mounted to the back side of the diaphragm, and another end of the voice coil is located between the magnet and the U-shaped cup.

2. The speaker as claimed in claim 1, wherein the positioning structure is an annular structure, a periphery of a back side of the diaphragm is positioned on a front side of the annular structure, and a back side of the annular structure is restricted on the speaker body.

3. The speaker as claimed in claim 2, wherein the annular structure is a metal ring.

4. The speaker as claimed in claim 1, wherein the speaker body further includes a protective cover, the protective cover covers a front side of the diaphragm, and a periphery of the protective cover is restricted by an inner wall of the holder.

5. The speaker as claimed in claim 4, wherein the protective cover has an annular restricting portion extending backward from a back side of the protective cover, and a periphery of a front side of the diaphragm is restricted by the annular restricting portion.

6. The speaker as claimed in claim 1, wherein the holder has two open ends, an inner wall of the holder has an annular positioning portion, front and back sides of the annular positioning portion are formed with a first mounting seat and a second mounting seat respectively, the positioning structure and the U-shaped cup are mounted to the first mounting seat and the second mounting seat respectively, and a periphery of the positioning structure is restricted by the inner wall of the holder.

7. The speaker as claimed in claim 6, wherein the first mounting seat and the second mounting seat are a first annular restricting face and a second annular restricting face respectively, and the positioning structure and the U-shaped cup are attached to the first annular restricting face and the second annular restricting face, respectively.

8. The speaker as claimed in claim 1, wherein the back side of the holder is formed with a positioning groove, and a circuit board is provided in the positioning groove.

9. The speaker as claimed in claim 1, wherein a surface of the diaphragm is plated with a plating layer.

* * * * *